US006664723B1

(12) United States Patent
Park et al.

(10) Patent No.: US 6,664,723 B1
(45) Date of Patent: Dec. 16, 2003

(54) SHADOW MASK IN COLOR CATHODE RAY TUBE

(75) Inventors: Yoon San Park, Kyongsangbuk-do (KR); Gwang Heon Ha, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/435,603

(22) Filed: Nov. 8, 1999

(30) Foreign Application Priority Data

Nov. 6, 1998 (KR) ..... 98/47462

(51) Int. Cl.[7] ..... H01J 29/07; H01J 29/80
(52) U.S. Cl. ..... 313/402; 313/408
(58) Field of Search ..... 313/402–408, 313/409, 441

(56) References Cited

U.S. PATENT DOCUMENTS 4,162,421 A * 7/1979 Morrell ..... 313/403
4,950,944 A * 8/1990 Fujimura ..... 313/407
5,631,520 A * 5/1997 Inoue et al. ..... 313/402
6,326,722 B1 * 12/2001 Shimizu et al. ..... 313/402
6,333,594 B1 * 12/2001 Nakagawa et al. ..... 220/2.1 A
6,420,823 B1 * 7/2002 Tanaka ..... 313/402
6,590,327 B2 * 7/2003 Furusawa et al. ..... 313/402

FOREIGN PATENT DOCUMENTS

| | | |
|---|---|---|
| JP | 62-213044 | 9/1987 |
| JP | 6-302284 | 10/1994 |
| JP | 11-273586 | 10/1999 |
| JP | 2000-149809 A | 5/2000 |

* cited by examiner

*Primary Examiner*—Nimeshkumar D. Patel
*Assistant Examiner*—Karabi Guharay
(74) *Attorney, Agent, or Firm*—Birch, Stewart, Kolasch & Birch, LLP

(57) ABSTRACT

Shadow mask in a color cathode ray tube, which provides an appropriate picture quality for a set resolution and has an increased overall strength by a bi-curvatured structure with a reinforced center portion, including a curvature structure formed according to a curvature function g1(x, y), the curvature function g1(x, y) including a peripheral curvature function f1(x, y) of the shadow mask having a predetermined curvature and a central curvature function f2(x, y) having an almost flat curvature, both the predetermined curvature and the almost flat curvature being formed according to an inside surface curvature of a panel, and a curvature function f3(x, y) having a curvature which is stable in view of structure.

13 Claims, 12 Drawing Sheets

$Ph_0 < Ph_1 < Ph_2 < \cdots\cdots Ph_n$ $Ph_{00} > Ph_{0n}$ $Ph_{n/20} \fallingdotseq Ph_{n/2n}$ $Ph_{n0} < Ph_{nn}$

SHADOW MASK IN COLOR CATHODE RAY TUBE

BACKGROUND OF THE INVENTION

1. Field of the Invention

The present invention relates to a shadow mask in a color cathode ray tube, and more particularly, to a shadow mask in the color cathode ray tube, having a curvature structure with a reinforced center portion for implementing a flat image.

2. Background of the Related Art

In general, the cathode ray tubes are mainly used in image displays, such as TV receivers, or computer monitors. FIG. 1 illustrates a side view of a related art color cathode ray tube with a partial cut away view.

Referring to FIG. 1, the related art color cathode ray tube is provided with a fluorescent film 2 inside of a panel 1 having red, green and blue fluorescent material coated thereon, a funnel 3 welded to rear of the panel 1, and an electron gun 4 provided in a neck portion 3*a* of the funnel. There is the shadow mask 6 fixed to a frame 7 close to the fluorescent film 2 for selecting colors form the electron beams 5 emitted from the electron gun 4. The frame 7 is fixed to a sidewall of the panel 1 hung therefrom by means of a holding spring 8 fixed to the frame 7 and inserted in a stud pin 9 fixed to the sidewall. There is an inner shield 10 on one side on one side of the frame 7 fixed by a holding spring 1 for protecting the electron beams 5 moving toward the fluorescent film 2 from an external geomagnetic field. There are 2, 4, or 6 pole magnet 13 on an outer circumference of the neck portion 3*a* for adjusting a path of travel of the electron beams so that the electron beams 5 can hit onto a desired fluorescent material exactly, and there is a reinforcement band 12 wounded around on an outer circumference of the cathode ray tube for preventing damage from an external impact when the cathode ray tube is in operation. In the foregoing basic structure of the cathode ray tube, the shadow mask 6 is formed to have a designed radius of curvature and assembled with the panel with a fixed space between the panel 1 and the shadow mask 6, to form a panel assembly. The shadow mask 6 facilitates the three electron beams emitted from the electron gun 4 to hit on the fluorescent material inside of the panel 1 through the shadow mask 6 exactly, for reproducing an image.

FIG. 2 illustrates a cross section of a panel assembly, referring to which the curvature and layout of the shadow mask 6 will be explained in detail.

In general, the radius of curvature of the shadow mask 6 is designed such that a relation of 0.70<Rm/Rp is established with reference to a diagonal axis where Rp is an inside surface radius of curvature of the panel 1, and Rm is a radius of curvature of the shadow mask 6. Accordingly, provided that the inside surface radius of curvature Rp of the panel 1 is given, the radius of curvature Rm of the shadow mask 6 is primarily dependent on the inside surface radius of curvature Rp of the panel 1. Along with the primary dependence on the inside surface radius of curvature of the panel, the shadow mask 6 is designed taking a G/R (grouping rate) which fixes a color purity of the image into consideration, which G/R, an array of the electron beams (distance) can be expressed with the following equation with reference to FIGS. 3A~3C.

$$\text{Beam Grouping Rate}(G/R) = \frac{3 \times S \times Q}{Ph \times L} = \frac{B}{A} \times 1.5$$

Where, S: a deflection yoke component

Q: a distance from a slot in the shadow mask to an inside surface of the panel

Ph: a center distance between slots in shadow mask(or a pitch of the slot=A)

L: a distance from an electron beam deflection center of a deflection yoke to an inside surface of the panel B: a center distance to each of centers of R(red) and B(blue) beams from the center of G(green) beam A: a pitch of the slot(Ph)

The beam grouping rate(G/R) in general color cathode ray tube is set such that the electron beams hit a desired fluorescent dot exactly all over the effective surface of the shadow mask to improve a color purity, i.e., set to G/R=1.000(Just). That is, if the inside surface radius of curvature Rp of the panel 1 is fixed, the deflection yoke, i.e., a deflection yoke component 'S' is fixed, and an electron beam incident angle for each position is set according to the fixed deflection yoke component 'S'. And, as illustrated in FIG. 3C showing a relative array of the three beams passing through the slits in the shadow mask 6, a critical horizontal pitch 'Ph' represented as 'A' is fixed to meet a screen resolution requirement for a given video signal, and once the panel 1, the funnel 3 and the deflection yoke are fixed, a distance 'L' from a deflection center of the deflection yoke to the inside surface of the panel 1 is fixed. Therefore, if changes in the curvature and the radius of curvature Rm of the shadow mask 6 is required, as 'L' and 'S' are constants, the slop pitch Ph should be changed. According to the equation, in order to make the radius of the curvature Rm of the shadow mask 6 smaller under a state the array of electron beam is fixed, the pitch Ph of the slot 6*a* should be designed greater, but, in order to make the radius of curvature Rm of the shadow mask 6 is greater, the pitch Ph of the slot 6*a* should be designed smaller. For example, as shown in FIG. 4*a*, when the radius of curvature of the shadow mask 6 is made smaller, the slot horizontal pitch Ph is set so that the slot horizontal pitch Ph has a relation of $Ph_0<Ph_1<Ph_2$ - - - $Ph_n$ starting from a center to a periphery of the shadow mask 6. As shown in FIG. 4B, if the horizontal slot pitch Ph is set greater, due to a limitation of effective surface of the shadow mask 6, the vertical pitch is changed appropriately to have a relation of $Ph_{00}>Ph_{0n}$, $Ph_{n/20}\approx Ph_{n/2n}$, and $Ph_{n0}>Ph_{nn}$. In conclusion, as discussed, since the beam grouping rate (G/R) is influenced from the inside surface radius of curvature of the panel 1 basically, the curvature of the shadow mask 6 is varied under a condition of fixed G/R, i.e., G/R=1.00, taking color purity characteristics into consideration. Accordingly, the curvature and the radius of curvature Rm of a conventional shadow mask 6 is dependent on the inside surface curvature of the panel 1 under the condition of the basic design criteria(0.70<Rm/Rp) and a fixed G/R(=1.00).

Recently, as the inside surface curvature at a center of the panel 1 has become greater for implementing a flat image, as shown in FIG. 5, the inside radius of curvature Rp of the panel becomes smaller as it goes from the center of the inside surface of the panel 1 towards ends of long axis (X-axis), short axis (Y-axis) and diagonal axis (D-axis). That is, the center portion of the panel 1 becomes flatter.

long axis radius of curvature Rpx: Rpx1>Rpx2>Rpx3>Rpx4> - - - short axis radius of curvature Rpy: Rpy1>Rpy2>Rpy3>Rpy4> - - - diagonal axis radius of curvature Rpd: Rpd1>Rpd2>Rpd3>Rpd4> - - -

Accordingly, as discussed, because the curvature and the radius of curvature Rm of the shadow mask 6 is dependent on an inside curvature structure of the panel, a shadow mask having a great radius of curvature at a center thereof is designed. In such a[s] shadow mask 6, for example, when the center radius of curvature is greater than 3,300 mm, the shadow mask 6 becomes weak, and is susceptible to deformation by an external physical force in handling the shadow mask 6 in a fabrication process, or deterioration of howling characteristics by an impact or a speaker sound during operation of the cathode ray tube.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, which provides an appropriate picture quality for a set resolution and has an increased overall strength by a bi-curvatured structure with a reinforced center portion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a color CRT includes a curvature structure formed according to a curvature function g1(x,y), the curvature function g1(x,y) including a peripheral curvature function f1(x,y) of the shadow mask having a predetermined curvature and a central curvature function f2(x,y) having an almost flat curvature, both the predetermined curvature and the almost flat curvature being formed according to a curvature function f3(x,y) corresponding to an inside surface curvature of a panel, resulting in a curvature which is stable in view of structure.

The region of the maximum radius of curvature is set within a range $\frac{1}{2}L \leqq F \leqq \frac{2}{3}L$ for preventing deterioration of purity characteristics, where 'F' denotes the region of the maximum radius of curvature and 'L' denotes a distance starting from a center of the shadow mask to an end of a useful surface in any direction.

The curvature function g1(x, y) is an arithmetic average of the curvature functions of f1(x, y), f2(x, y) and f3(x, y).

The shadow mask has a long axis(X-axis) having a radius of curvature similar to an inside surface curvature of the panel, short axis and diagonal axis each having a radius of curvature fixed according to the curvature function g1(x, y).

The curvature structure according to the curvature function g1(x, y) has a beam grouping rate G/R which is a group rate(G/R<1) in a central portion of the shadow mask, and a de-group rate(G/R>1) in a peripheral portion of the shadow mask.

The group rate(−X) is set approx. two time greater than the de-group rate(+X), wherein the beam grouping rate in overall is set within a range of 0.94~1.030 by setting the de-group rate(+X) to be max. 0.03 and the group rate(+X) to be max. −0.06, for maintaining an appropriate purity.

Accordingly, the shadow mask in a color CRT of the present invention can improve an overall strength while an appropriate picture quality is maintained, thereby preventing deformation by an external force and howling caused by impact or speaker sound during operation of the CRT.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 6A:
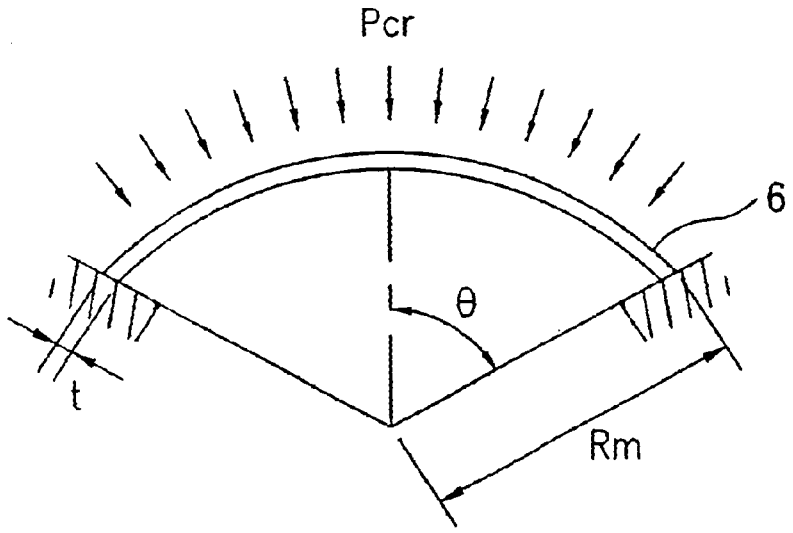
FIGS. 6A~6C explains a curvature structure of the present invention, schematically.
Figure 6B:
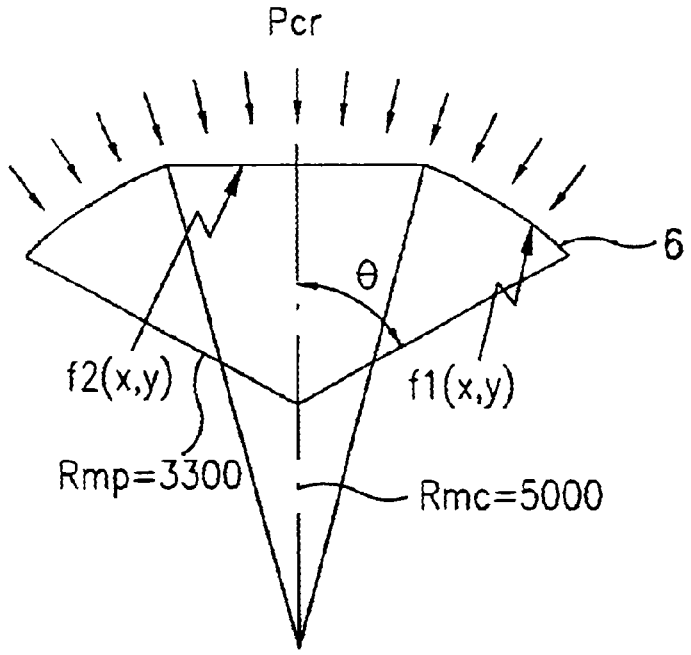
Figure 6C:
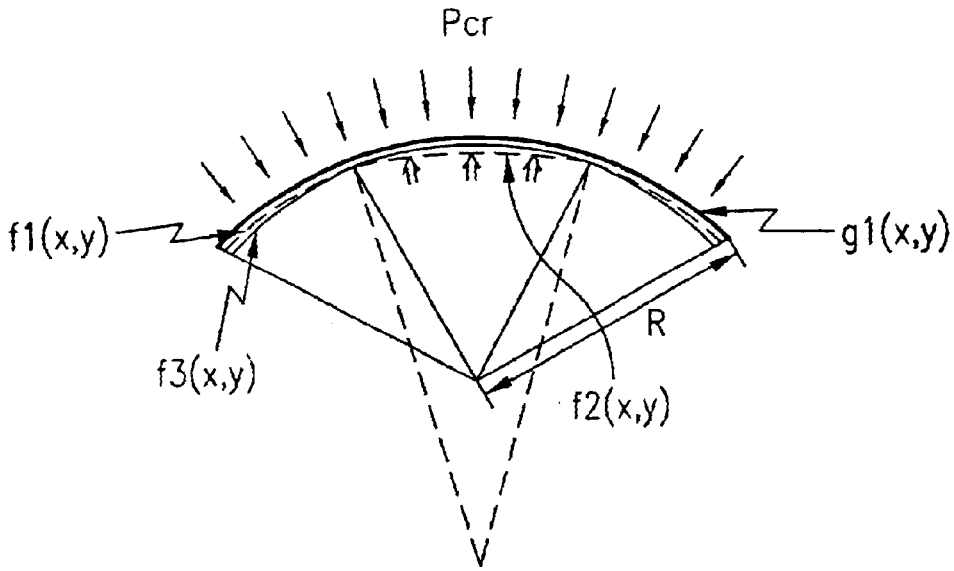
Figure 7:
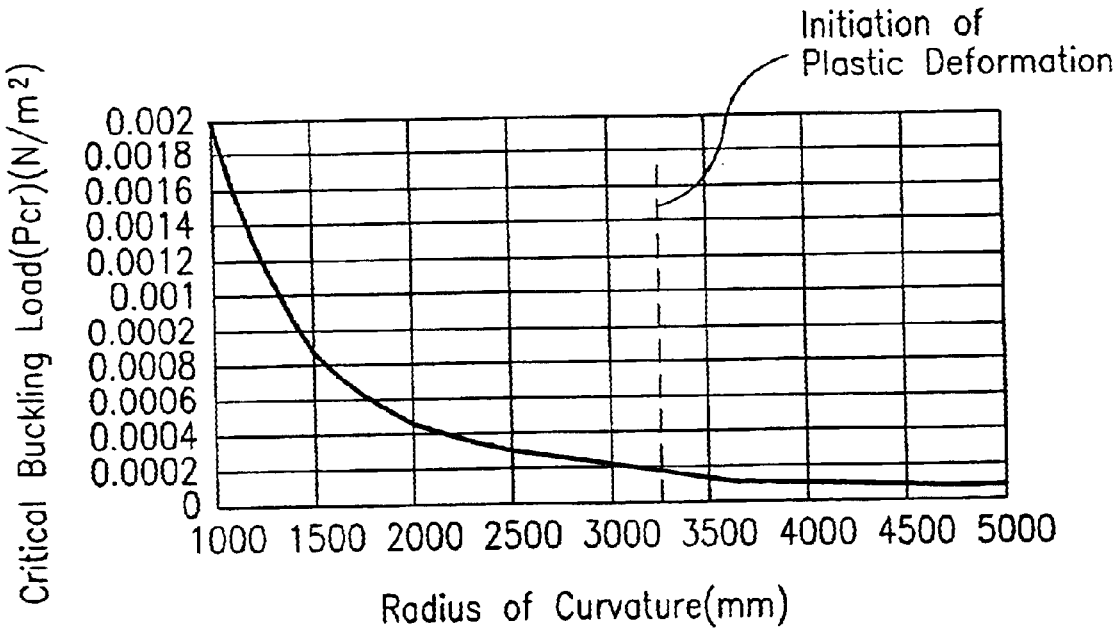
FIG. 7 illustrates a graph showing a critical buckling pressure vs. radius of curvature in a spherical shell structure.

Reference will now be made in detail to the preferred embodiments of the present invention, examples of which are illustrated in the accompanying drawings. In explaining the present invention, the same names and reference numerals will be given to the same components, and explanations on the same will be omitted. FIGS. 6A~6C explains a bi-curvatured structure of the present invention schematically, and FIG. 7 illustrates a graph showing a critical buckling pressure vs. radius of curvature in a spherical shell structure, referring to which a principle of the bi-curvatured structure of the shadow mask 6 of the present invention will be explained.

In general, inside of a color CRT(Cathode Ray Tube) has a high vacuum(approx. $10^{-7}$ torr), and a shadow mask 6 in a form of thin plate having a required curvature is mounted in the CRT with both ends thereof fixed to a frame 7. As shown in FIG. 6A, such a shadow mask 6 may be assumed to be a clamped spherical thin shell with an external pressure, of which critical buckling pressure Pcr may be expressed with the following equation.

$$P_{cr} = \left(0.14 + \frac{3.2}{\left\{[12(1-\nu^2)]^{1/4}\sqrt{\left(\frac{Rm}{t}\right)}\,2\sin\frac{\theta}{2}\right\}^2}\right)\frac{2}{\sqrt{3(1-\nu^2)}}E\left(\frac{t}{Rm}\right)^2$$

Where, v: a Poisson's ratio

E: a modulus of elasticity of the shadow mask

Rm: a radius of curvature of the shadow mask t: a thickness of the shadow mask

θ: ½ of an angle the shadow mask forms.

It can be known from the equation that the critical buckling pressure Pcr is inversely proportional to the radius of curvature Rm of the shadow mask 6. Moreover, referring to FIG. 7 which illustrates a graph showing a relation between the critical buckling pressure Pcr and the radius of curvature of the shadow mask 6 based on the equation, it can be known that the critical buckling pressure Pcr drops sharply as the radius R of curvature increases and a plastic deformation starts without a great increase of the radius of curvature. In addition to this, when a relation is taken into account that the radius Rm of curvature and the curvature are inversely proportional, the critical buckling pressure Pcr and the curvature of the shadow mask 6 are proportional.

In the meantime, the shadow mask 6 in the color cathode ray tube that implements a flat image has a curvature different from the foregoing theoretical shell structure. A curvature of such an actual shadow mask 6 is shown in FIG. 6B. In fact, a flat image is implemented when an inside surface curvature at a center of the panel is a representative radius of curvature 4R(1R=1.767×a diagonal distance). On application of the design reference (0.7<Rm/Rp) to such a panel, for example, in a case of 27" panel (with a diagonal distance 676 mm), while the radius of curvature Rm at a periphery of the shadow mask 6 is Rm>3300, the radius of curvature Rm' at a center of the shadow mask 6 is Rm'= 5000, that is almost flat. That is, when it is assumed that a curvature function of the radius of curvature Rmp at a periphery of the shadow mask 6 is f1(x,y), and the curvature function of the radius of curvature Rmc at the center of the shadow mask 6 is f2(x,y), the shadow mask 6 for the panel has a bi-curvatured structure with two curvatures of f1(x,y) and f2(x,y). As explained in the relation between the radius of curvature Rm and the critical buckling pressure Pcr, in such a curvature structure, an area to which the flat curvature function f1(x,y) is applicable has substantially small critical buckling pressure Pcr. Especially, a stress from a pressure caused by a high vacuum is occurred only in a vertical direction of the shadow mask 6. Accordingly, as shown in FIG. 6C, a new curvature function g1(x,y) of the present invention is applied to design the shadow mask 6 for compensation of the center critical strength of the shadow mask 6. The curvature function g1(x,y) includes the two conventional curvature functions f1(x,y) and f2(x,y) and the curvature function f3(x,y) resulting in a mask which is stable in view of structure. In other words, the curvature function g1(x,y) of the present invention is an average of the f1(x,y), f2(x,y) and f3(x,y). Therefore, the radius R of curvature by the curvature function g1(x,y) becomes [the] smaller along opposite circumferential directions centered on a point the basic design curvatures f1(x,y) and f2(x,y) are met, i.e., in the vicinity of an inflection point of the basic design curvatures.

The curvature function g1(x,y) of the present invention is not applied to all of the three representative axes of the shadow mask 6, i.e., the long axis(X-axis), the short axis (Y-axis) and the diagonal axis(D-axis)(not shown), for the convenience of design and fabrication). That is, a radius Rx of curvature on the long axis(X-axis) of the shadow mask 6 is designed according to the inside surface radius Rp of the panel 1, and the radius of curvature Ry on the short axis(Y-axis) and the radius Ry of curvature on the diagonal axis (D-axis) are designed according to the g1(x,y). In conclusion, if lengths of respective axes are made dimensionless relative to one another, and an inflection point of the curvature of the curvature function g1(x,y) are set to be (x3,y3), the radius R of curvature of the present invention can be expressed as follows.

long axis radius of curvature Rx: Rx1>Rx2>Rx3>Rx4> - - - short axis radius of curvature Ry: Ry1>Ry2>Ry3>Ry4> - - - diagonal axis radius of curvature Rd: Rd1>Rd2>Rd3>Rd4> - - -

Figure 8:
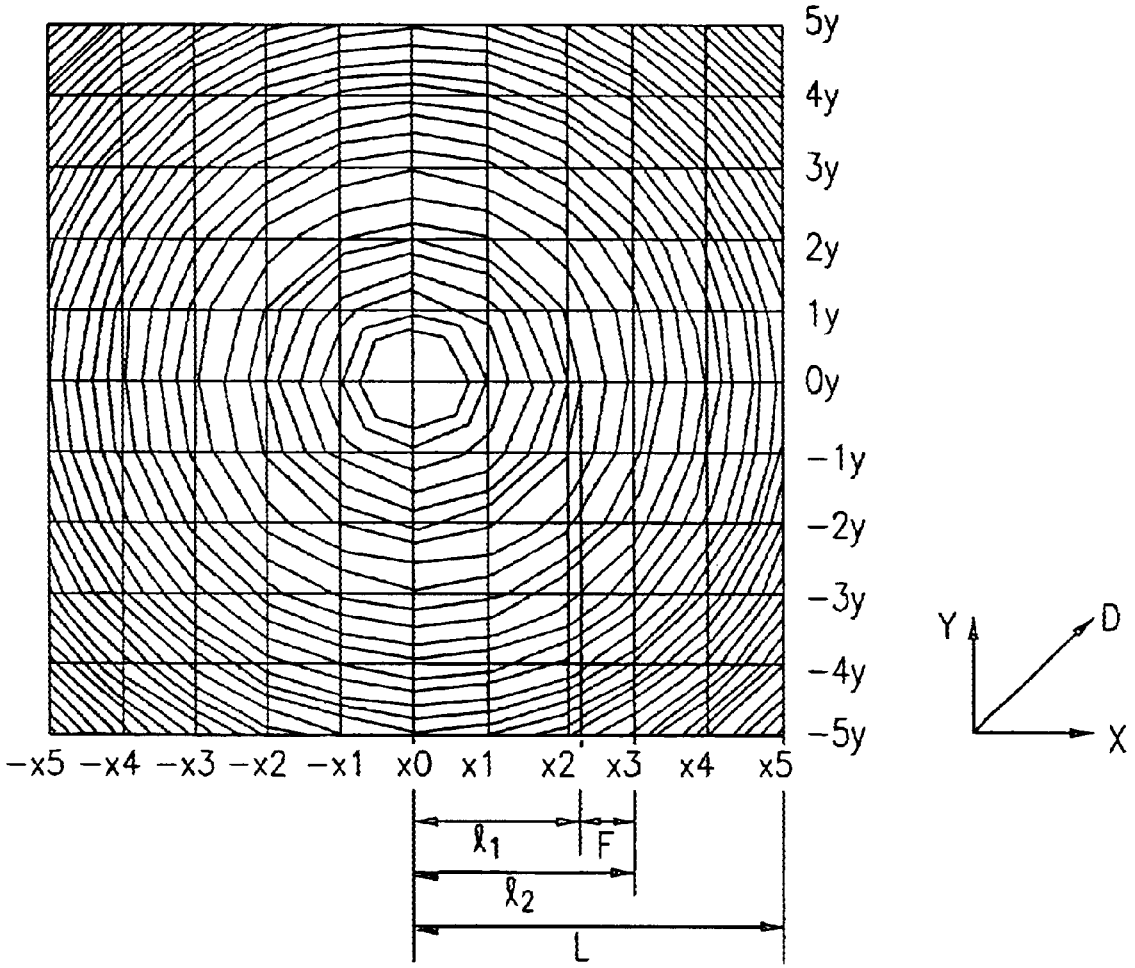
FIG. 8 illustrates a contour on a two dimensional plane of a curvature structure implemented by a curvature function g1(x,y) of the present invention.

FIG. 8 illustrates a contour on a two dimensional plane of a curvature structure implemented by a curvature function g1(x,y) of the present invention. A zone with a close contour represents a zone with a small radius R of curvature of the shadow mask 6, and a zone with coarse contour represents a zone with a great radius R of curvature of the shadow mask 6, referring to which an overall curvature change of the shadow mask 6 of the present invention will be explained in detail.

When 11 and 12(11>0, 11<12) denote distances from the center of shadow mask 6 to one direction, and L(12<L) denotes a distance from the center of the shadow mask 6 to an end of effective surface in the one direction, there is a concentric region 'F', i.e., a region 'F' symmetric to respective axes, having a maximum radius Rmax of curvature formed between the 11 and 12 based on the curvature function g1(x,y). Centered on such a region 'F', a central portion of the shadow mask 6, i.e., a region inside of the region 'F' and a peripheral portion of the shadow mask 6, i.e., a region outside of the region 'F' have radiuses 'R' and R" of curvature smaller than Rmax, respectively. Since the color purity characteristics for the curvature change is the most stable at a point one half of a distance from the center to the effective surface of the shadow mask 6, it is preferable that the region 'F' having the maximum radius of curvature Rmax is positioned at a place of ½L≦F≦⅔L. According to this, the curvature of the present invention can be implemented without a deterioration of the purity characteristics.

Figure 9A:
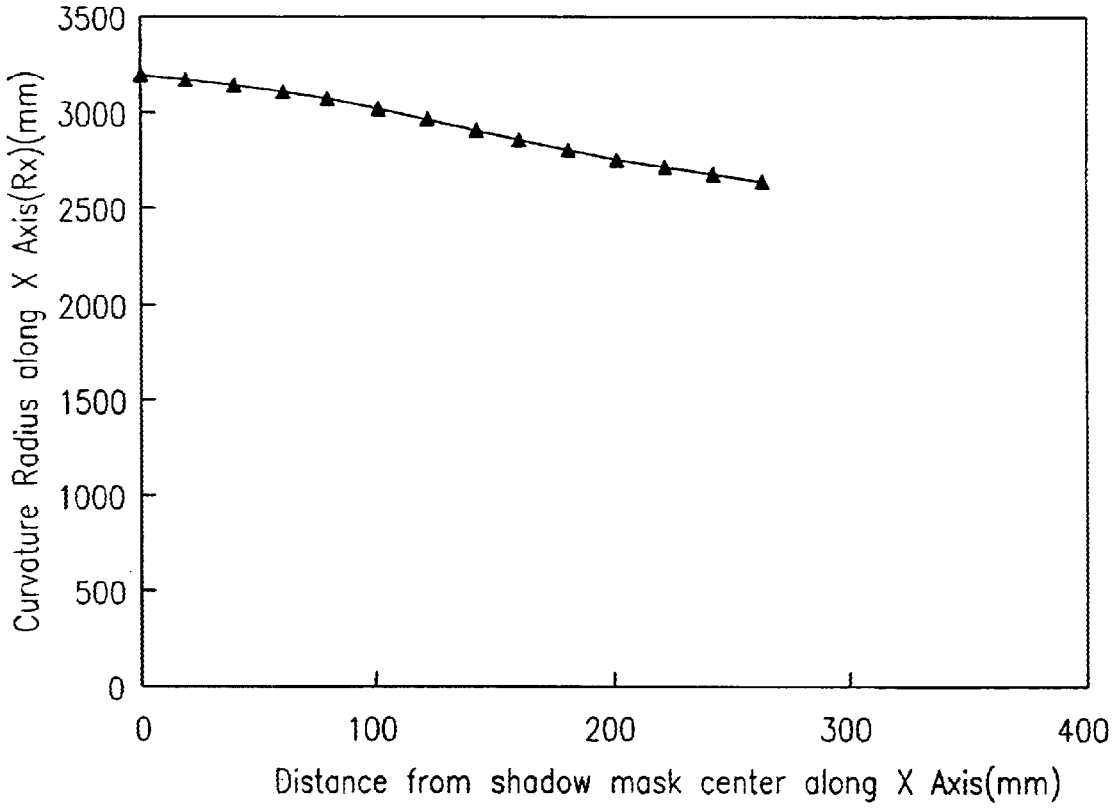
FIGS. 9A~9C illustrate graphs showing changes of radiuses of curvatures along respective axes started from a center of a shadow mask; and, FIG. 10 illustrates a graph comparing changes of radiuses of curvatures.
Figure 9B:
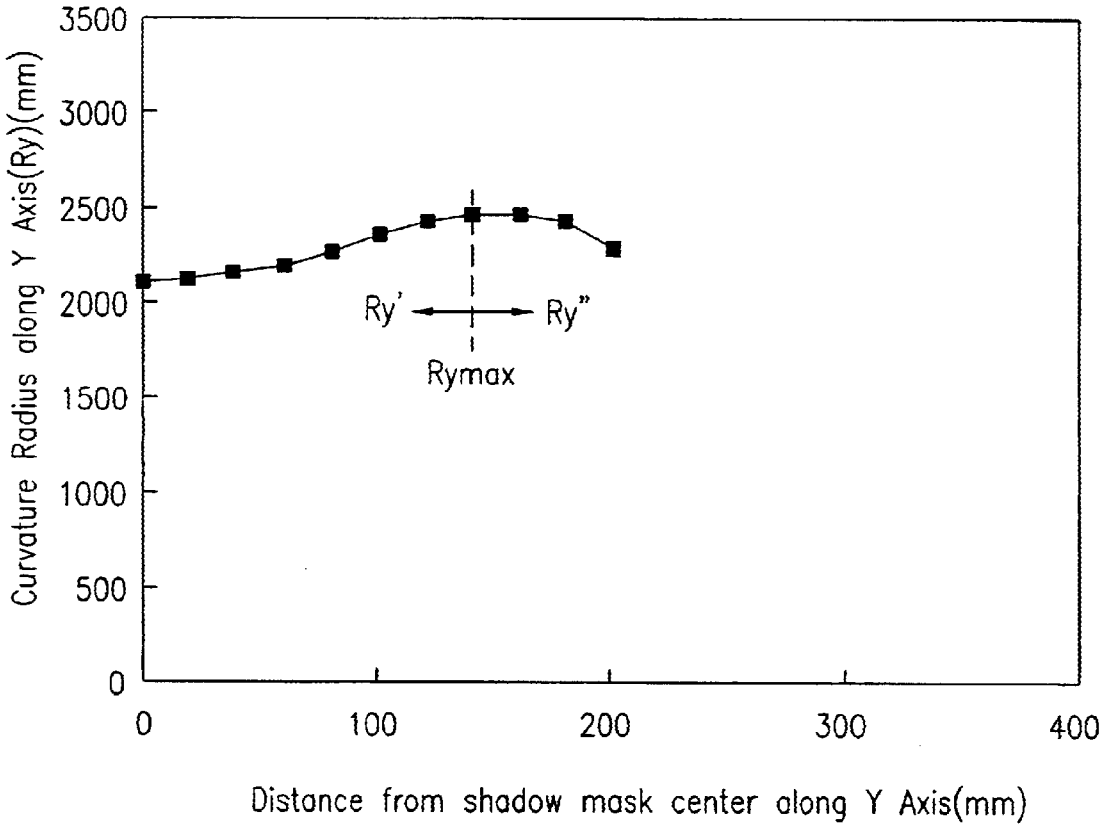
Figure 9C:
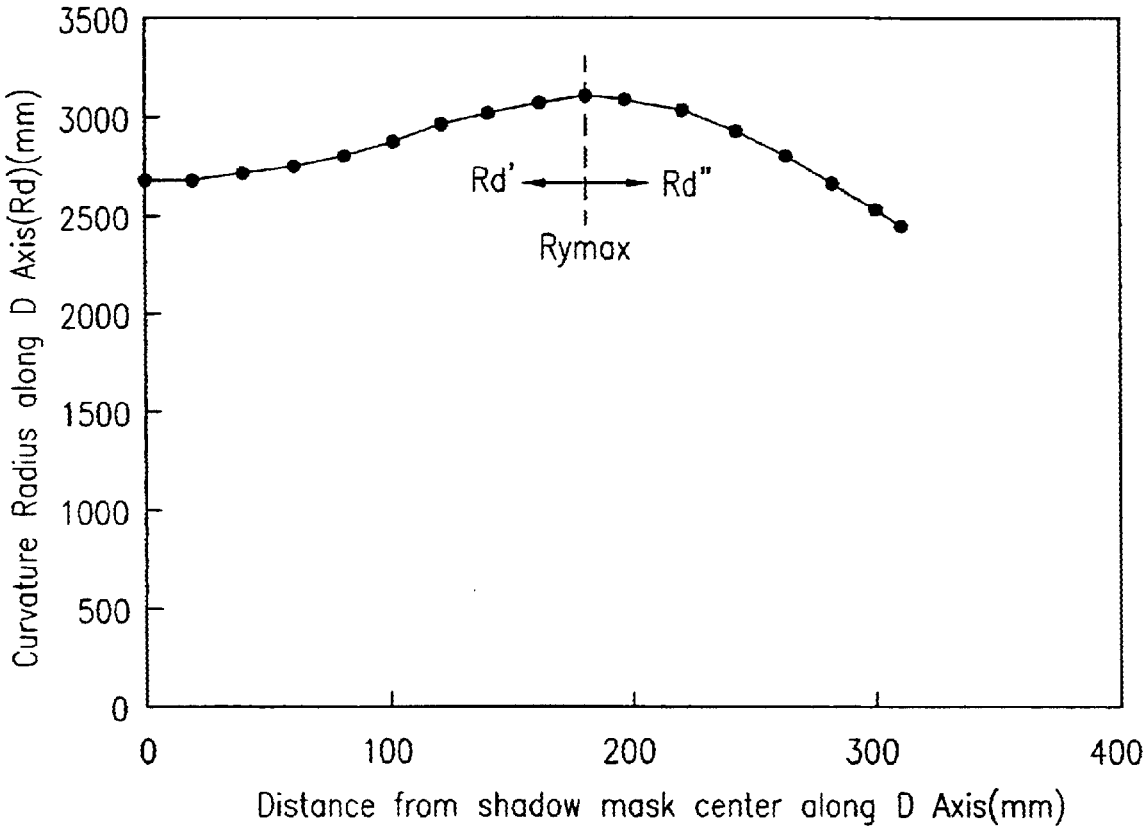

FIGS. 9A~9C illustrate graphs provided for showing an overall curvature structure of the shadow mask in detail, wherein changes of radiuses of curvatures along respective axes (X-axis, Y-axis, and D-axis) started from a center of the shadow mask 6 are shown based on a 27" panel.

Referring to FIGS. 9B and 9C, it can be known that the radiuses Ry and Rd of curvatures of the shadow mask in the short axis (Y-axis) and the diagonal axis (D-axis) directions have the maximum radiuses Rmax of curvatures at regions between the center and ends of the effective surface of the shadow mask. Also, it can be known that the radiuses Ry and Rd of curvatures of the shadow mask in the short axis (Y-axis) and the diagonal axis (D-axis) directions have smaller radiuses of curvatures (Ry' and Ry"), (Rd' and Rd") gradually reduced centered on the maximum radius of curvature Rmax. On the other hand, as shown in FIG. 9A, the curvature of the shadow mask 6 in the long axis (X-axis) direction has a maximum curvature at the center similar to the inside surface curvature of the panel, and has a radius of curvature gradually reduced to the end of the effective surface. As the curvature and radius curvature are inversely proportional, it can be known that the curvatures in respective axis directions are inversions of the graph shown in FIGS. 9A, 9B and FIG. 10 illustrates a graph comparing changes of radiuses of curvatures for respective axes.

Figure 10:
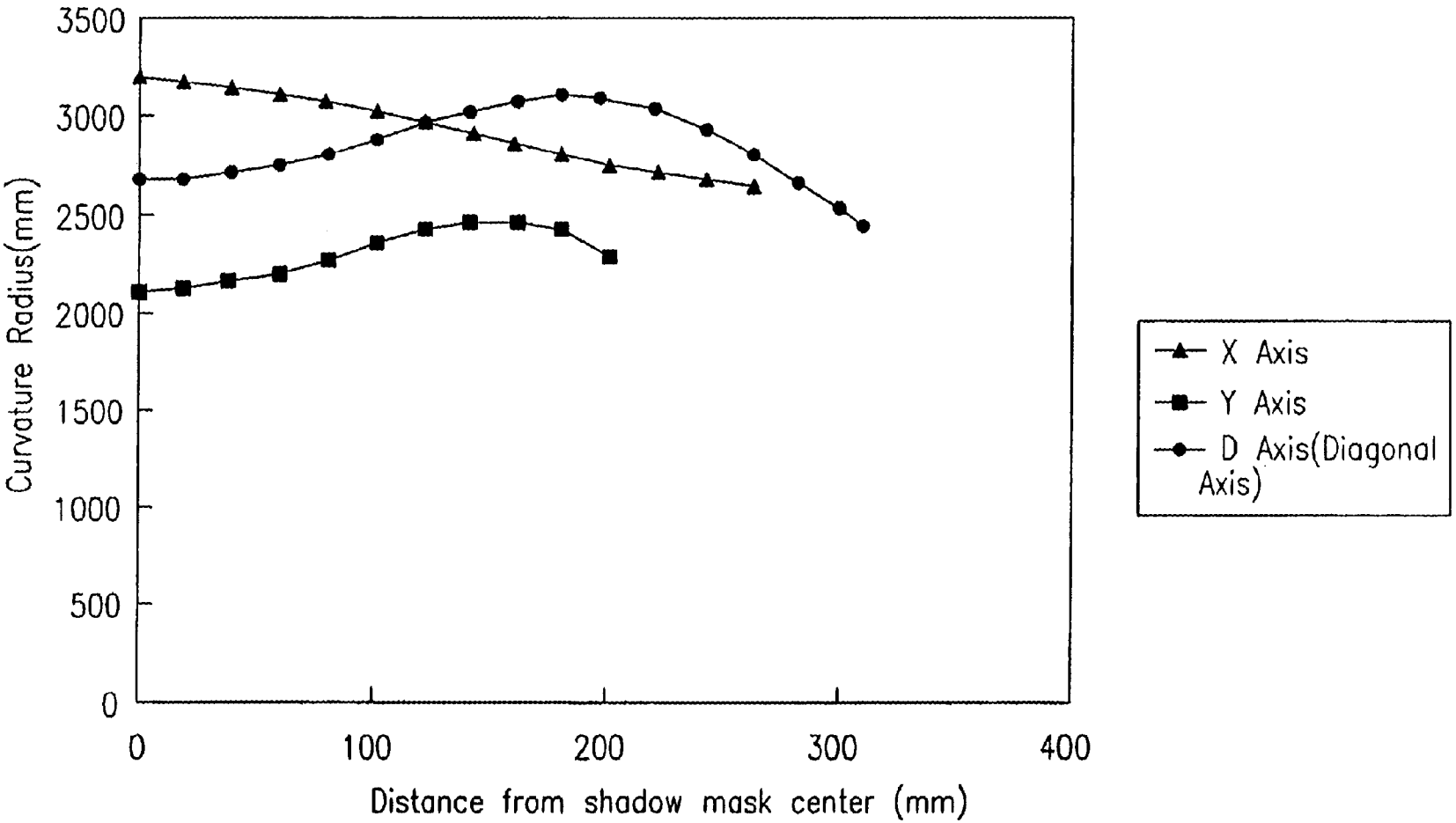

Referring to FIG. 10, curvature changes for respective axes are compared from region to region, to find that relative radiuses of curvature at the central portion of the shadow mask 6 is in the order of long axis(X-axis), diagonal axis(D-axis) and short axis(Y-axis), i.e., Rx>Rd>Ry. And, the relative radiuses of curvature at the peripheral region after the maximum radius of curvature 'F' is in the order of the diagonal axis(D-axis), long axis(X-axis), and short axis (Y-axis), i.e., Rd>Rx>Ry, showing the Ry the smallest, still. Accordingly, this disposition of radiuses of curvatures provides a shadow mask 6 which has a curvature structure easy to design and fabrication and reinforced at the central portion on the whole.

In the meantime, in formation of the curvature structure of the present invention explained above, the beam grouping rate that fixes a quality of an image, i.e., a color purity is also an important factor. Before explaining the beam grouping rate caused by the curvature structure of the present invention, three different beam grouping rates will be explained in detail with reference to FIG. 3C.

Figure 1:
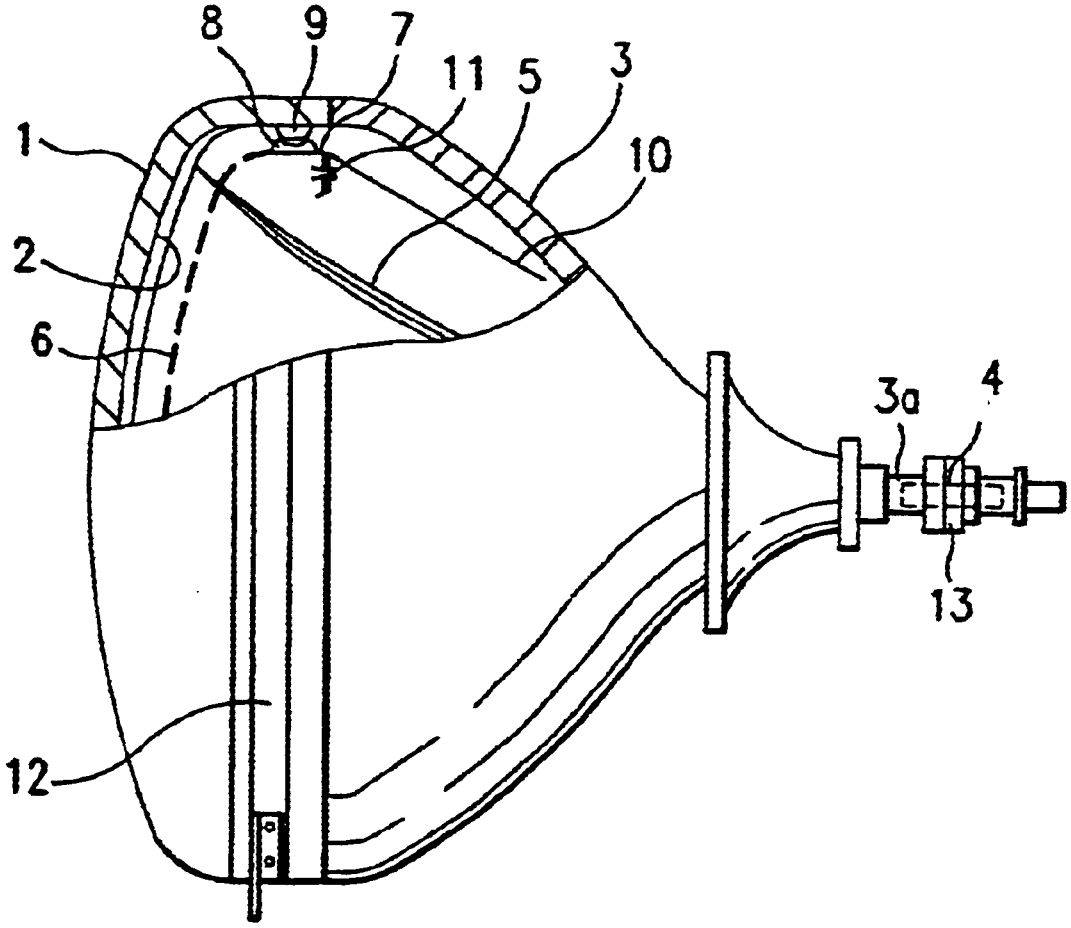
FIG. 1 RELATED ART
FIG. 1 illustrates a side view of a related art color cathode ray tube with a partial cut away view.
Figure 2:
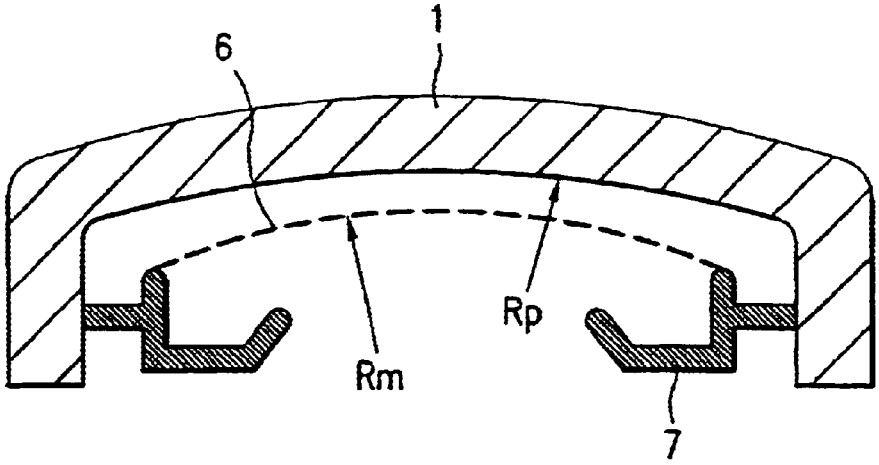
FIG.2 RELATED ART
FIG. 2 illustrates a cross section of a panel assembly of the CRT in FIG. 1.
Figure 3A:
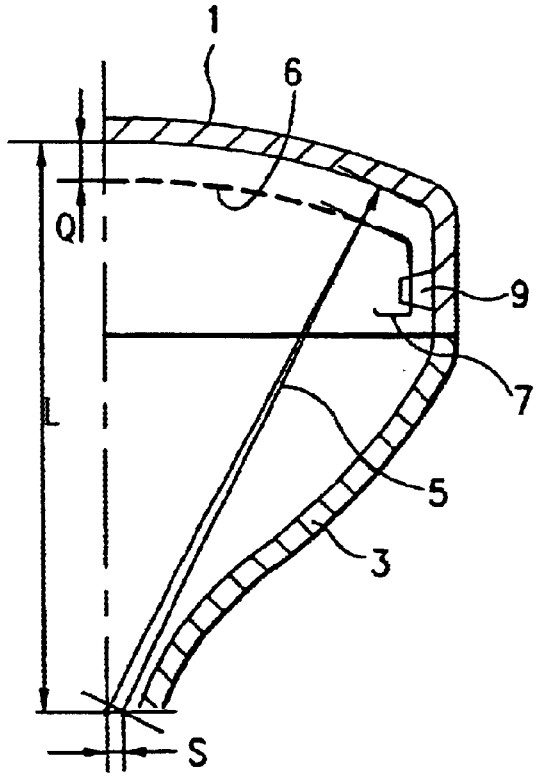
FIG. 3A illustrates a partial sectional view of a CRT showing an internal layout.
Figure 3B:
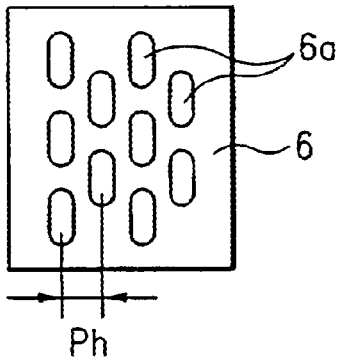
FIG. 3B illustrates a front view showing a portion of a shadow mask.
Figure 3C:
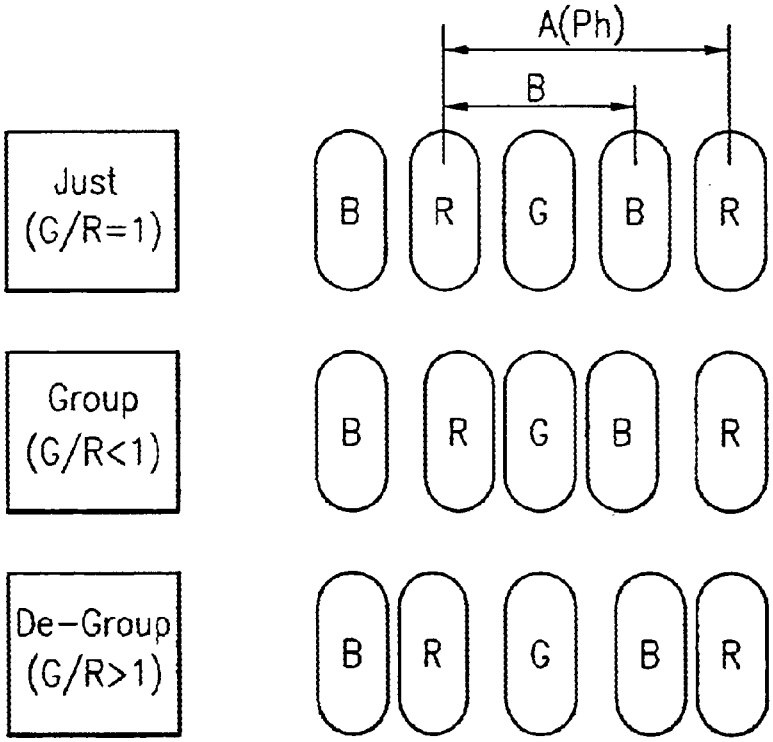
FIG. 3C illustrates a beam grouping rate, schematically.
Figure 4A:
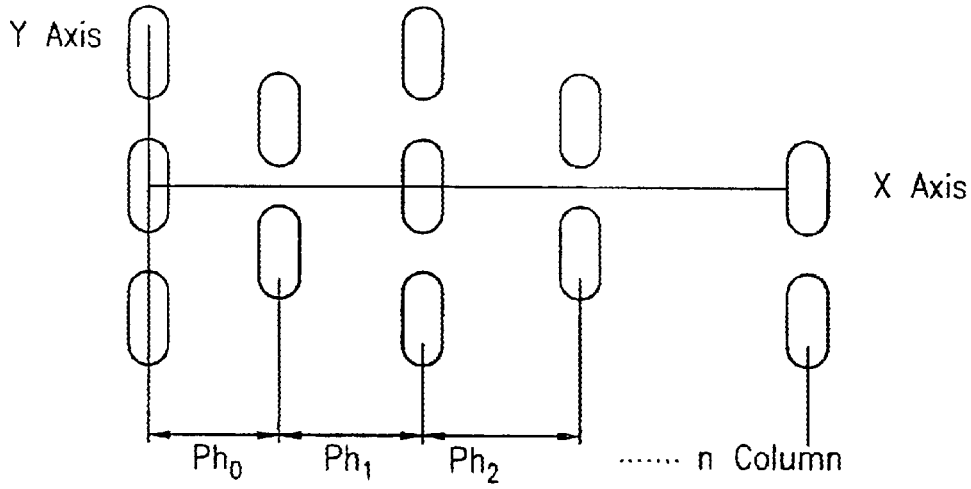
FIGS. 4A~4B illustrate pitches of a shadow mask, schematically.
Figure 4B:
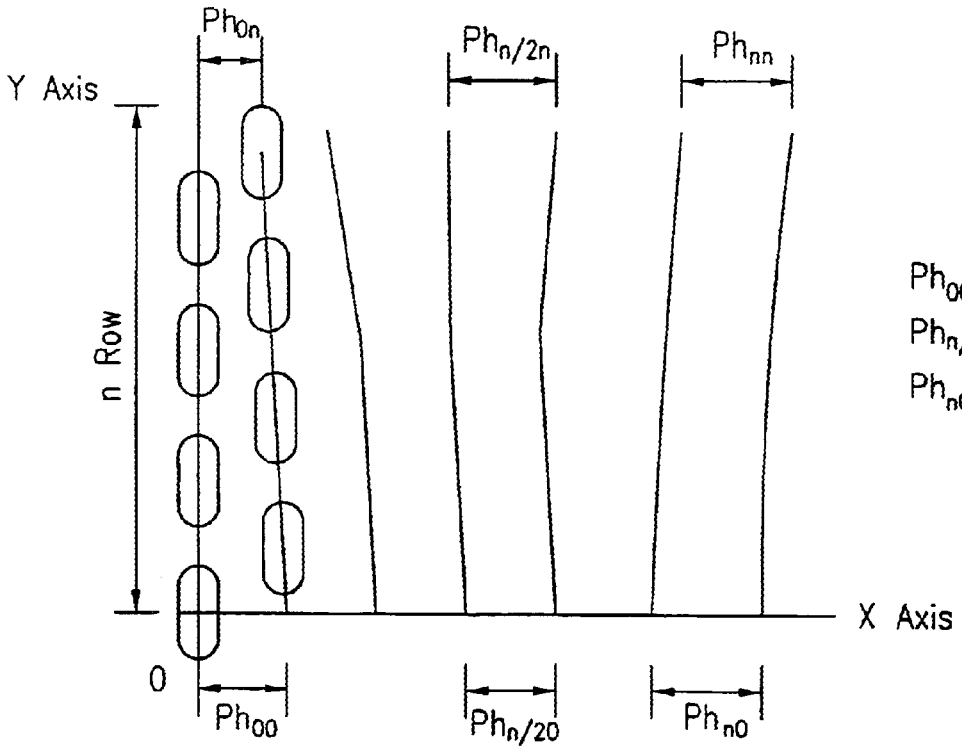
Figure 5:
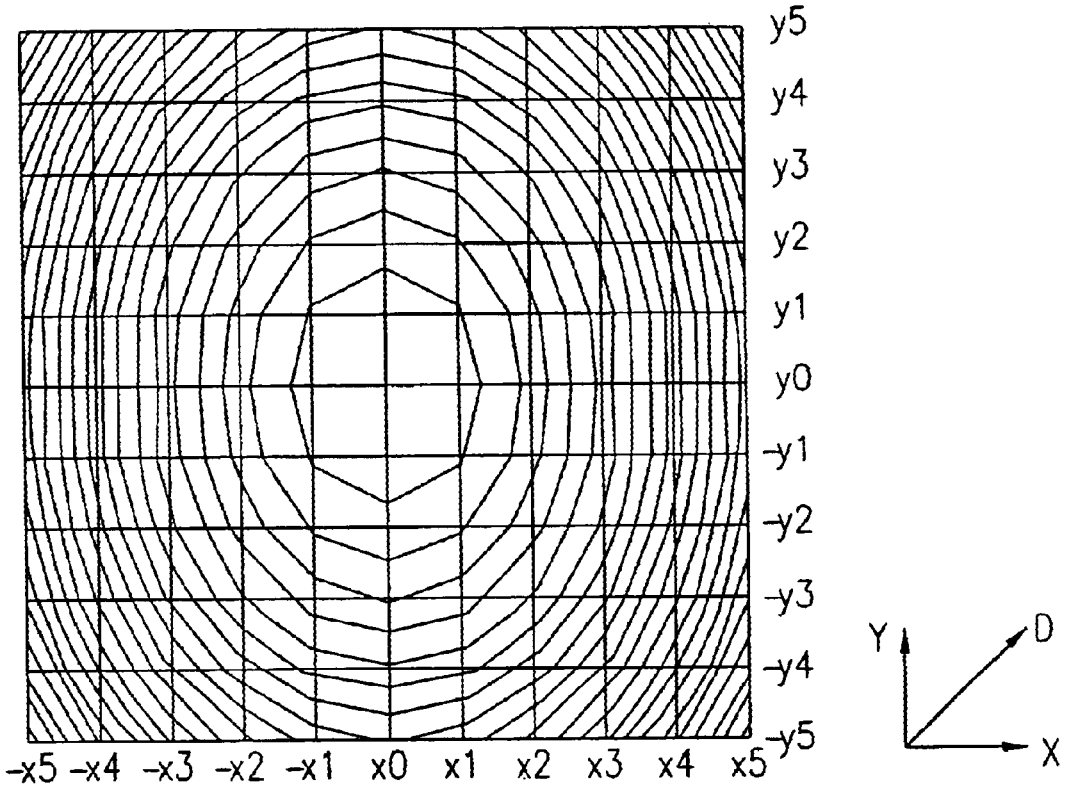
FIG. 5 illustrates a contour of an inside surface curvature structure of a panel on a two dimensional plane.

Referring to FIG. 3, in general, the De-Group G/R(G/R>1) has a distance 'B' between a 'G' beam, a center beam, and one of side beams of 'R' and 'B' beams greater than the horizontal pitch Ph, opposite to this the Group G/R(G/R<1) has the distance 'B' smaller than the horizontal pitch Ph, and the Just G/R(G/R=1) has the same distance 'B' and the horizontal pitch Ph. Such beam grouping rates can be expressed as G/R=1.000±X centered on the Just G/R, where ±X is a group or de-group rate. And, an allowance enough to prevent adjacent fluorescent dots from being caused to be luminous when the R, G, B electron beams emitted from the electron gun hit the R, G, B fluorescent dots coated on the fluorescent material inside of the panel 1 respectively is called as a purity allowance. As explained, because the horizontal pitch Ph is greater than the distance 'B', in general, the purity allowance of the group G/R is approx. two times of the purity allowance of de-group G/R under a condition of the same rate(X). Therefore, if the purities are set to be the same, the group rate −X may be designed to be two times greater than the de-group rate +X. On the other hand, under a condition that other variables are constant, if one range of beam grouping rate(G/R) is designed to the group rate(−X), to design the horizontal pitch Ph reversely proportional to the beam grouping rate greater, the region designed to the group rate(−X) can be designed to have a small radius of curvature which is stable in view of structure. As has been explained, in order to reinforce the central portion of the shadow mask, the electron beam grouping rate according to the curvature structure of the present invention is set to be the group rate(G/R<1) for central portion, and to be the de-group rate(G/R>1) for the peripheral portion of the shadow mask. In actual application of the foregoing beam grouping rates to the curvature structure of the present invention, if the shadow mask curvature varied centered on the region 'F' having the maximum radius curvature Rmax is designed such that the de-group rate(+X) is set to be maximum 0.03 for maintaining an appropriate purity, the group rate(−X) can be set to be maximum 0.06. That is, the beam grouping rate is within a range of 0.94<G/R<1.030 throughout the shadow mask 6, permitting an appropriate picture quality when an image is displayed.

As has been explained, the present invention can improve a strength of the shadow mask by providing a bi-curvatured structure having the reinforced central portion while a picture quality according to a set resolution is maintained. Therefore, in a case when an external force is applied to the shadow mask 6 in handling the shadow mask 6 during fabrication by negligence, deformation can be minimized and howling caused by impact or speaker sound can be prevented in operation of the cathode ray tube.

It will be apparent to those skilled in the art that various modifications and variations can be made in the shadow mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a color cathode ray tube comprising:

an intermediate region formed apart from a center with a predetermined distance, the intermediate region having a predetermined radius of curvature;

a central region continuously formed from the intermediate region, the central region having a radius of curvature smaller than the radius of curvature in the intermediate region; and a peripheral region formed continuously from the intermediate region, the peripheral region having a radius of curvature smaller than the radius of curvature in the intermediate region.

2. The shadow mask according to claim 1, wherein the intermediate region is set within a range $\frac{1}{2}L \leqq F \leqq \frac{2}{3}L$, where 'F' denotes the intermediate region and 'L' denotes a distance starting from the center of the shadow mask and extending in all directions to an end of an effective surface.

3. The shadow mask according to claim 1, wherein the shadow mask has a radius of curvature in a long axis direction similar to a radius of curvature in an inside surface of a panel.

4. The shadow mask according to claim 3, wherein the radius of curvature in the long axis includes a maximum radius of curvature at the center of the shadow mask and radii of curvature gradually reduced to an end of the effective surface.

5. The shadow mask according to claim 1, wherein a radius of curvature in a short axis direction includes a maximum radius of curvature in the intermediate region and radii of curvature in the central and peripheral region smaller than the maximum radius of the curvature.

6. The shadow mask according to claim 1, wherein a radius of curvature in a diagonal axis direction includes a maximum radius of curvature in the intermediate region and radii of curvature in the central and peripheral region smaller than the maximum radius of the curvature.

7. The shadow mask according to claim 1, wherein a beam grouping rate in the central region is smaller than 1, and a beam grouping rate in the peripheral region is greater than 1, where the beam grouping rate is a ratio of a distance between centers of R(red) beam and B(blue) beam to a pitch of a slot.

8. The shadow mask according to claim 7, wherein the overall beam grouping rate is set within a range of 0.94–1.030.

9. The shadow mask according to claim 1, wherein a panel adjacent to the shadow mask has an inner surface having radii of curvature in a long, short and diagonal axis reduced gradually from a center to an end of the effective surface thereof.

10. The shadow mask according to claim 1, wherein a panel has an almost flat outer surface.

11. A cathode ray tube comprising:

a panel;

a funnel being fixed to the rear of the panel;

an electron gun provided in a neck portion of the funnel, and emitting electron beams; and a shadow mask disposed adjacent to the panel and selectively passing the electron beams, the shadow mask including;

an intermediate region formed apart from a center with a predetermined distance, the intermediate region having a predetermined radius of curvature;

a central region continuously formed from the intermediate region, the central region having a radius of curvature smaller than the radius of curvature in the intermediate region; and a peripheral region formed continuously from the intermediate region, the peripheral region having a radius of curvature smaller than the radius of curvature in the intermediate region.

12. A cathode ray tube comprising:

a panel;

a funnel being fixed to the rear of the panel;

an electron gun provided in a neck portion of the funnel, and emitting electron beams; and a shadow mask disposed adjacent to the panel, and selectively passing the electron beams, the shadow mask having a radius of curvature in a short axis which is increased to a predetermined length and is then reduced, between a center region and a peripheral region.

13. A cathode ray tube comprising:

a panel;

a funnel fixed to rear of the panel;

an electron gun provided in a neck portion of the funnel, and emitting electron beams; and a shadow mask disposed adjacent to the panel, and selectively passing the electron beams, the shadow mask having a radius of curvature in a diagonal axis which is increased to a predetermined length and is then reduced, between a center region and a peripheral region.

* * * * *